United States Patent [19]

Cover

[11] Patent Number: 4,544,992

[45] Date of Patent: Oct. 1, 1985

[54] LIGHTING FIXTURE INSULATING SYSTEM

[76] Inventor: Craig H. Cover, P.O. Box 755, Newtown, Pa. 18940

[21] Appl. No.: 538,172

[22] Filed: Oct. 3, 1983

[51] Int. Cl.[4] ..... F21S 1/14

[52] U.S. Cl. ..... 362/147; 362/294; 362/369; 362/408

[58] Field of Search ..... 362/147, 294, 404, 408, 362/409, 410, 369

[56] References Cited

U.S. PATENT DOCUMENTS

| | | | |
|---|---|---|---|
| 2,648,764 | 8/1953 | Kirlin | 362/294 |
| 4,044,246 | 8/1977 | Docimo et al. | 362/294 |
| 4,104,713 | 8/1978 | Chan et al. | 362/294 |
| 4,107,768 | 8/1978 | Lemkin | 362/373 X |
| 4,302,798 | 11/1981 | Sit | 362/147 |
| 4,313,153 | 1/1982 | Davis | 362/147 X |
| 4,356,540 | 10/1982 | Goralnik | 362/294 |

*Primary Examiner*—Peter A. Nelson

*Attorney, Agent, or Firm*—Gregory J. Gore

[57] ABSTRACT

The present invention is directed to a lighting fixture thermal insulating system which incorporates the space-age technology of layered metallized polymer insulation. The present invention utilizes a structure and combination which yields an insulation system of superior performance while being cost competitive and because of reduced space requirement creates greater freedom of design in the manufacture of lighting fixtures. The laminations of metallized polymer and a spacer material may be located above or below the mounting pan or both.

9 Claims, 4 Drawing Figures

LIGHTING FIXTURE INSULATING SYSTEM

BACKGROUND OF THE INVENTION

1. Field of the Invention

This invention pertains to lighting fixture insulation and is designed to be used in the mounting apparatus for lighting fixtures to insulate the heat generated in the lighting fixture from the supporting building structure, such as a wall or ceiling as well as the outlet box to which it is affixed. Proper thermal insulation of lighting fixtures is necessary for proper safety and lightbulb longevity.

2. The Prior Art

General safety requirements within the lighting fixture industry are set by Underwriters' Laboratories which must be closely adhered to. Many efforts have been made through the use of structure, ventilation, heat dissipation and heat insulation in order to meet these safety requirements and also fulfill the asthetic requirement of a commercially viable lighting fixture. There are numerous patents in this field, among them which may be mentioned as relevant to the instant application are U.S. Pat. Nos. 4,044,246, 4,104,713, 4,234,916, 4,302,798 and 4,356,540. All of these referenced patents seek to propose solutions to the heat transfer problem mentioned above but none has achieved the same results and none has employed the method of the instant invention.

Prior art solutions to the problem of heat conductivity to the electrical outlet box and to adjacent building materials have been structural designs which reduce the amount of heat conductivity between the fixture pan and the outlet box. The instant invention on the other hand reduces the amount of heat transfer by reducing the amount of heat transmitted to the lighting fixture pan and outlet box with intermediate layers of insulation as described below.

SUMMARY OF THE INVENTION

The present invention discloses the first known successful application of a metallized polymer insulation to lighting fixtures. The material is laminated between spacer material and applied in a specific fashion to be used either in the pan area of the lighting fixture mount or between the pan and the lightbulb. Because of the effectiveness of this insulating system, manufacturers may realize much greater freedom of design and reduced labor costs in constructing and assembling a complete insulated lighting fixture.

The system as further disclosed herein uses a low-emissivity metallized polymer which is built-up in sandwich-like layers between alternating layers of a spacer material. For cost reasons, the most appropriate polymer substrate to be used in the lighting fixture industry are those such as polyethylene, polyethyleneterephthalate (PET), polypropylene and various flourocarbon films. The spacer material is between ½ and ¼ thick and may be made of varying densities of fiberglass, ceramic paper, NOMEX or any one of a number of other fire retardant materials or combinations thereof. An additional function of the spacer material is to further ensure that there is no metal to metal contact between layers of the metallized film or between the metal parts of the lighting fixture and the metallized side of the polymer film. The metal used is aluminum which is vacuum deposited on the polymer substrate.

More specifically, the insulation system disclosed herein is constructed using two or more layers of metallized polymer. Each layer consists of a layer of spacer material laminated to a layer of low-emissivity metallized polymer film. The number of layers and their placement will vary with the size and shape of the fixture. For example, many fixtures do best with a configuration of a two-layer section installed on the face of the mounting pan and a second two-layer section placed inside the mounting pan. Approximately the same performance will be observed by installing all four layers on the face with no insulation in the pan. The choice will depend on the manufacturer's preference, taking into account fixture size, shape, asthetics and so on.

It is imperative in the application of the insulating material to the lighting fixture body that the metallized side of the polymer film be oriented towards the lightbulb regardless of whether the layers are installed on the face or in the pan. This means that, if the material is to be used inside of the pan, the first layer or the layer closest to the heat source, which would necessarily touch the metal face of the pan, will be the fiberglass spacer material and the second layer will be the metallized polymer with the metallized side facing the heat source with successive layers in similar orientation.

With this insulating material used on the face of the pan, the first layer does not begin with spacer material, but a foil covering which prevents scorching. This is followed by successive layers of metallized polymer and fiberglass.

One of the advantages of this system is the reduced requirement of insulation space. This makes possible many new and interesting fixture designs as well as removing the difficulty of installation. Furthermore, the reduced depth of insulation reduces the installation time and cost which often is otherwise lessened during installation by workers who remove insulation to make installation easier. This results in a final product which is inherently safer for installation reasons alone. In laboratory tests using U.L. test procedures, it has been shown that the current insulation system requiring 2⅛ inch of insulation can be replaced with the laminated metallized polymer system as described above with a total insulation thickness of only one inch. This improvement is, therefore, not only a commercial benefit for the lighting fixture industry, but also results in a safer product for the consumer.

The invention disclosed herein describes a lighting fixture having a mounting pan for ceiling or wall mounting and a lightbulb with the improvement comprising; thermal insulation affixed to said mounting pan, said insulation comprising the combination of a polymer film, a metal vacuum deposited on said polymer film, and spacer material located between successive layers of the metallized polymer.

Accordingly, it is an object of the invention to provide an improved lighting fixture which is of the low heat transfer type and is relatively inexpensive to manufacture.

It is a further object of the instant invention to provide a lighting fixture of a low heat transfer type which is compact, occupies very little space, and is easy to install.

DESCRIPTION OF THE PREFERRED EMBODIMENT

Figure 1:
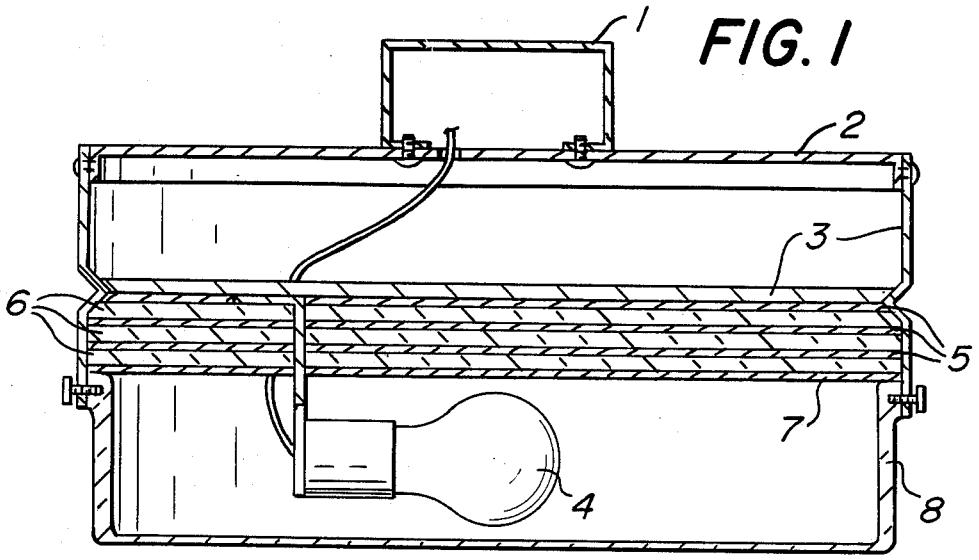
FIG. 1 is a vertical sectional view through a lighting fixture in accordance with the invention using the layer of insulation below the pan only.

FIG. 1 shows the vertical cross-sectional view of a typical lighting fixture which incorporates the laminated insulation as described above. Outlet box 1 is affixed to mounting pan 3 by the usual mounting screws which generally accomodate a crossbar member 2 with adjustable slotting. The mounting pan 3 is then affixed to the crossbar 2 in any one of many commonly used techniques, usually by direct bolting. A three-layer composition of insulating material is shown mounted directly below the face of the mounting pan directly above the lightbulb 4. Sheets of 92-guage metallized polmer 5 are separated by spacing material 6 which in this case is ¼" fiberglass. Polymer sheets 5 have bottom surfaces metallized with aluminum and in each case the metallized side of the polymer material is facing the lightbulb.

Protective foil sheet 7 is placed between the lightbulb and a first layer of metallized polymer and spacer material in order to prevent scorching.

Figure 2:
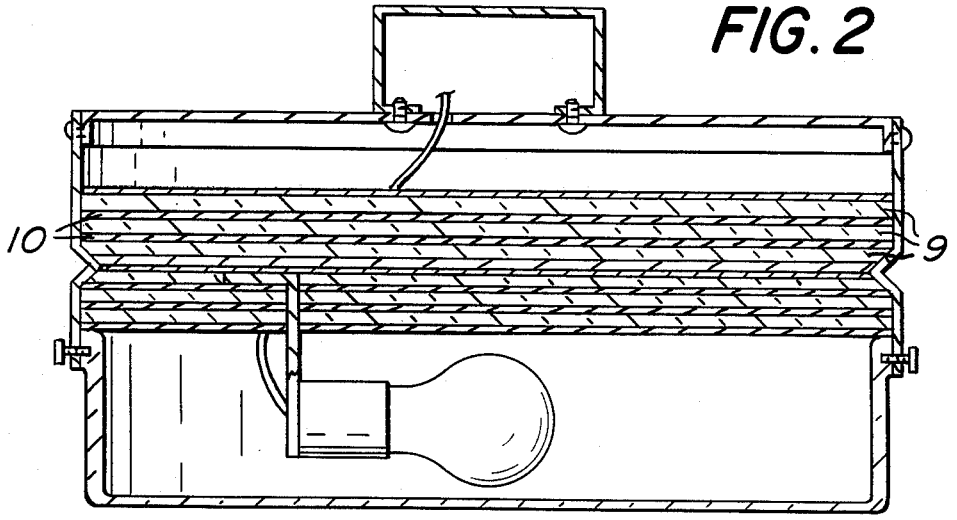
FIG. 2 is a vertical sectional view of the lighting fixture showing the location of the thermal insulating material when used both above and below the mounting pan.
Figure 3:
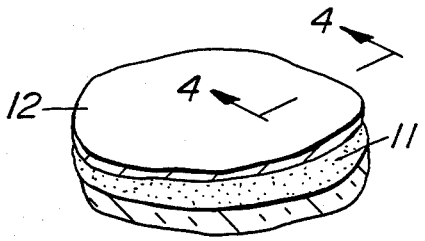
FIG. 3 is an isometric view of the thermal insulating material showing the layered construction.

This construction may be used as fully described to this point or further with the aid of additional insulating materials located inside the mounting pan just above the face of the pan as depicted in FIG. 2. In this case, the insulating material begins with the first layer being fiberglass spacer material 9 followed by a layer of the metallized polymer, 10 with the metallized face on the down side, and a second layer of fiberglass, and so on.

It should be noted that the fiberglass spacing material used as described herein, may be replaced by many other suitable materials previously mentioned without much effect on the insulating properties of the metallized polymer. The only requirement of the metallized polymer is that it be of the low-emissivity type, that is, having an emissivity of $0.03 \pm 0.005$. This may be of the type manufactured by National Metallizing, a Division of NMD, Inc., Princeton, N.J., under the name "Polymet." Polymer substrate provides an inexpensive reflective insulating mechanism.

Figure 4:
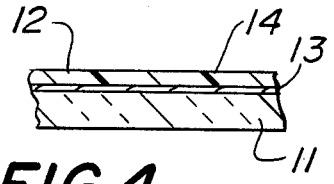
FIG. 4 is a cross-sectional view of the laminated insulation of FIG. 3 also showing the two-sided nature of the metallized polymer.

It should be understood that there may be many combinations of materials possible for the essential elements necessary to carry out the insulating system described above as shown in FIG. 4; a polymer substrate 14, metal vacuum deposited on the substrate 13, and spacer material 11.

Furthermore, it should be understood that there may be many modifications and adaptations of the specific embodiment of the present invention as described herein and still fall within the scope and spirit of the invention. It is therefore intended that the embodiment described herein not be a limitation on the scope of the invention which shall be determined by the appended claims.

What is claimed is:

1. In a lighting fixture having a mounting pan for ceiling or wall mounting, thermal insulation affixed to said mounting pan, and a lightbulb, the improvement, comprising:

thermal insulation containing two or more layers of a low-emissivity polymer, a metal deposited on each polymer layer, and an insulating spacer material located between the layers of said metallized polymer.

2. A lighting fixture in accordance with claim 1 wherein said metal is located between said lightbulb and the polymer on which it is deposited.

3. A lighting fixture in accordance with claim 2 wherein said thermal insulation is located between the face of the mounting pan and the lightbulb.

4. A lighting fixture in accordance with claim 2 wherein said insulation is located between the face of the mounting pan and the ceiling or wall on which it is mounted.

5. A lighting fixture in accordance with claim 2 wherein said thermal insulation is affixed to both sides of the mounting pan.

6. A fixture in accordance with claim 5 wherein a metal foil is located between the thermal insulation and the lightbulb.

7. A lighting fixture in accordance with claim 6 wherein said spacer material is fiberglass.

8. A lighting fixture in accordance with claim 7 wherein said polymer is a low-emissivity polyethyleneterephthalate.

9. A lighting fixture in accordance with claim 8 wherein said metal deposited on said polymer is aluminum.

* * * * *